US005269272A

United States Patent [19]

Nakaniwa

[11] Patent Number: 5,269,272

[45] Date of Patent: Dec. 14, 1993

[54] ENGINE IDLING SPEED CONTROL APPARATUS

[75] Inventor: Shinpei Nakaniwa, Gumma, Japan

[73] Assignee: Japan Electronic Control Systems Co., Ltd., Isezaki, Japan

[21] Appl. No.: 875,944

[22] Filed: Apr. 30, 1992

[30] Foreign Application Priority Data

May 2, 1991 [JP] Japan ..... 3-100779

[51] Int. Cl.[5] ..... F02M 3/00; F02M 3/06

[52] U.S. Cl. ..... 123/339

[58] Field of Search ..... 123/339

[56] References Cited

U.S. PATENT DOCUMENTS

| | | | |
|---|---|---|---|
| 4,856,475 | 8/1989 | Shimomura et al. | 123/339 |
| 4,879,983 | 11/1989 | Shimomura et al. | 123/339 |
| 4,989,565 | 2/1992 | Shimomura et al. | 123/339 |
| 5,024,196 | 6/1991 | Ohuchi | 123/339 |
| 5,035,217 | 7/1991 | Kako | 123/339 |
| 5,060,611 | 10/1991 | Krampe et al. | 123/339 |
| 5,065,717 | 11/1991 | Hosokai et al. | 123/339 |
| 5,069,181 | 12/1991 | Togai et al. | 123/339 |
| 5,070,837 | 12/1991 | Nishimura | 123/339 |
| 5,094,207 | 3/1992 | Krampe et al. | 123/339 |
| 5,133,319 | 7/1992 | Ikeda et al. | 123/339 |

FOREIGN PATENT DOCUMENTS

| | | |
|---|---|---|
| 62-32241 | 2/1987 | Japan . |
| 62-129544 | 6/1987 | Japan . |

*Primary Examiner*—Willis R. Wolfe
*Assistant Examiner*—Thomas Moulis
*Attorney, Agent, or Firm*—Foley & Lardner

[57] ABSTRACT

An apparatus for controlling the idling speed of an internal combustion engine. The apparatus comprises sensors for producing electrical signals indicative of sensed engine operating conditions including a sensed amount of air permitted to enter the engine. A control unit is coupled to the sensors for providing a feedback control to correct the amount of air permitted to enter the engine so as to maintain the engine idling speed at a target value when the engine is idling. The control unit calculates a difference of the sensed air amount from a reference value and corrects the target engine speed based upon the calculated difference.

3 Claims, 3 Drawing Sheets

ENGINE IDLING SPEED CONTROL APPARATUS

BACKGROUND OF THE INVENTION

This invention relates to an engine idling speed control apparatus arranged to provide a feedback control to correct the amount of air permitted to enter the engine so as to maintain the engine idling speed at a target value when the engine is idling.

For example, Japanese Patent Kokai No. 62-129544 discloses an engine idling speed control apparatus including an auxiliary air control valve provided in an auxiliary air passage bypassing a throttle valve situated within an engine induction passage. The control apparatus is arranged to change the duty factor of an electrical pulse signal applied to operate the auxiliary air control valve in such a manner as to provide a feedback control correcting the air flow through the auxiliary air passage to maintain the engine idling speed at a target value when the engine is idling. The engine idling speed control apparatus is arranged to avoid engine stall by increasing the target engine idling speed value as the external load increases. For this purpose, various switches are required to indicate the conditions of the respective external loads including an air conditioner, a power steering unit, head lights, rear defogers and the like. However, the use of these switches results in an expensive engine idling speed control apparatus. This is true particularly when a number of external loads are used.

SUMMARY OF THE INVENTION

It is a main object of the invention to provide an inexpensive engine idling speed control apparatus which can ensure accurate engine idling speed control having a good response to external load changes.

There is provided, in accordance with the invention, an apparatus for controlling the idling speed of an internal combustion engine. The apparatus comprises sensor means sensitive to engine operating conditions for producing electrical signals indicative of sensed engine operating conditions including a sensed amount of air permitted to enter the engine, and a control unit coupled to the sensor means for providing a feedback control to correct the amount of air permitted to enter the engine so as to maintain the engine idling speed at a target value when the engine is idling. The control unit includes means for calculating a difference of the sensed air amount from a reference value, and means for correcting the target engine speed based upon the calculated difference.

BRIEF DESCRIPTION OF THE DRAWINGS

This invention will be described in greater detail by reference to the following description taken in connection with the accompanying drawings, in which.

DETAILED DESCRIPTION OF THE INVENTION

Figure 1:
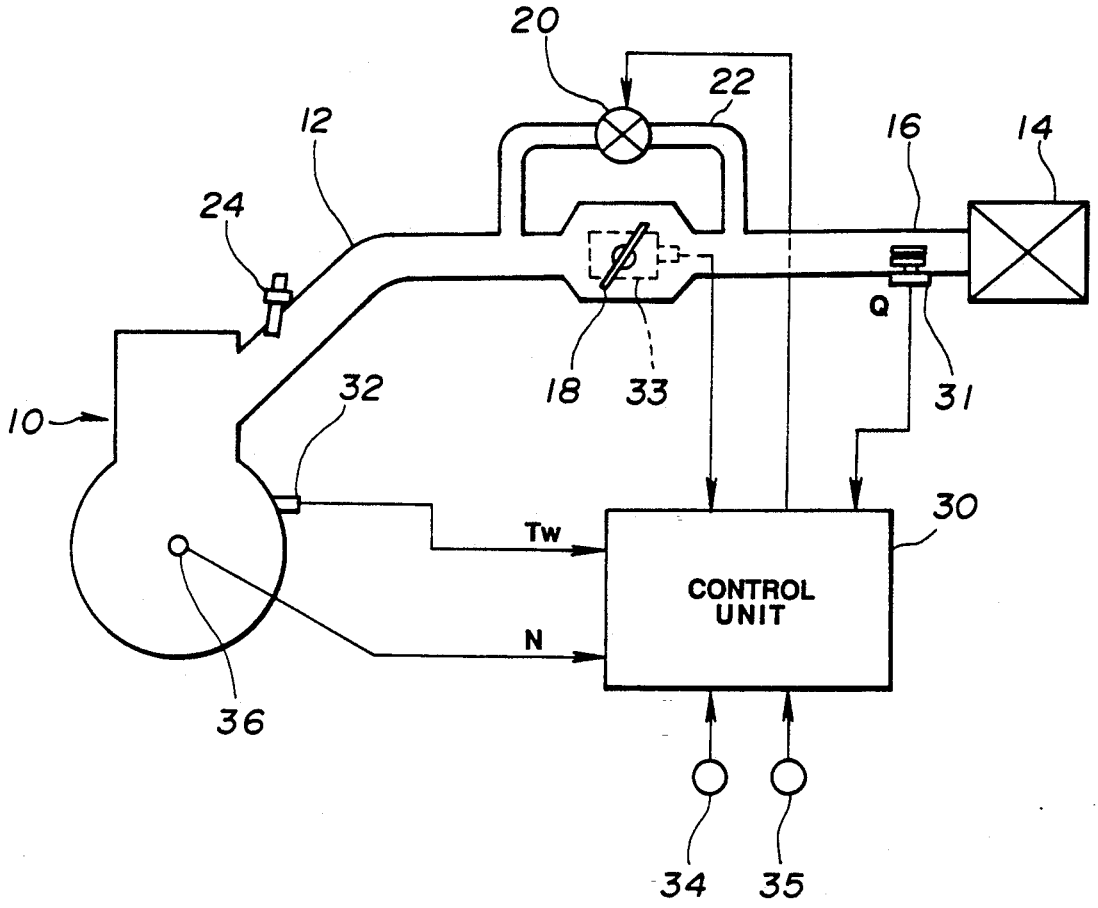
FIG. 1 is a schematic diagram showing one embodiment of an engine idling speed control apparatus made in accordance with the invention.

With reference to the drawings and in particular to FIG. 1, there is shown a schematic diagram of an engine idling speed control apparatus embodying the invention. An internal combustion engine, generally designated by the numeral 10, for an automotive vehicle includes combustion chambers or cylinders connected to an intake manifold 12.

Air to the engine 10 is supplied through an air cleaner 14 into an induction passage 16. The amount of air permitted to enter the combustion chambers through the intake manifold 12 is controlled by a butterfly throttle valve 18 situated within the induction passage 16. The throttle valve 18 is connected by a mechanical linkage to an accelerator pedal (not shown). The degree to which the accelerator pedal is depressed controls the degree of rotation of the throttle valve 18. An auxiliary air control valve 20 is provided in an auxiliary air passage 22 bypassing the throttle valve 18 to control the amount of air introduced into the intake manifold 12 at idling conditions where the throttle valve 18 is at its closed position. The auxiliary air control valve 20 opens to permit air flow through the auxiliary air passage 22 when it is energized by the presence of an electrical pulse signal. The duty factor of the electrical pulse, that is, the ratio of the pulse-width to the repetitive period, applied to the auxiliary air control valve 20 determines the length of time the auxiliary air control valve 20 opens during the repetitive period and, thus, determines the amount of air flow into the intake manifold 12. A fuel injector 24 is provided to inject a controlled amount of fuel into the intake manifold 12. In the operation of the engine 10, fuel is injected intermittently in synchronism with rotation of the engine 10 through the fuel injector 24 into the intake manifold 12 and mixed with the air therein.

The amount of air metered through the auxiliary air passage 22 into the intake manifold 12, this being determined by the duty factor of the electrical pulse signal applied to the auxiliary air control valve 20, is repetitively determined from calculations performed in a control unit 30, these calculations being based upon various conditions of the engine 10 that are sensed during its operation. These sensed conditions include intake air flow Q, engine coolant temperature Tw, throttle valve position, transmission gear position, vehicle speed V, and engine speed N. Thus, an intake air flow meter 31, an engine coolant temperature sensor 32, an idle switch 33, a neutral switch 34, a vehicle speed sensor 35 and an engine speed sensor 36 are connected to the control unit 30.

The intake air flow meter 31 is responsive to the air flow Q (kg/h) through the induction passage 16 to produce a signal proportional thereto. The engine coolant temperature sensor 32 preferably is mounted in the engine cooling system and comprises a thermistor connected in an electrical circuit capable of producing a DC voltage having a variable level proportional to engine coolant temperature. The idle switch 33 is responsive to the idling (or closed) position of the throttle valve 18 for closing to supply current from the car battery to the control unit 30. The neutral switch 34 is responsive to the position of the transmission gear in neutral for closing to supply current from the car battery to the control unit 30. The vehicle speed sensor 35 produces an electrical signal corresponding to the speed of running of the vehicle. The engine speed sensor 36 may include a crankshaft position sensor associated with an engine crankshaft to produce electrical pulses at a repetitive rate corresponding to the speed of rotation of the engine 10.

The control unit 30 may employ a digital computer which includes a central processing unit (CPU), a random access memory (RAM), a read only memory (ROM), and an input/output control circuit (I/O). The central processing unit communicates with the rest of the computer via data bus. The input/output control circuit includes an analog-to-digital converter which converts the analog signals received from the various sensors into digital form for application to the central processing unit. The read only memory contains the program for operating the central processing unit and further contains appropriate data in look-up tables used in calculating an appropriate value for the duty factor of the electrical pulse signal applied to the idling control valve 20. The look-up data may be obtained experimentally or derived empirically. The central processing unit may be programmed in a known manner to interpolate between the data at different entry points if desired.

Figure 2:
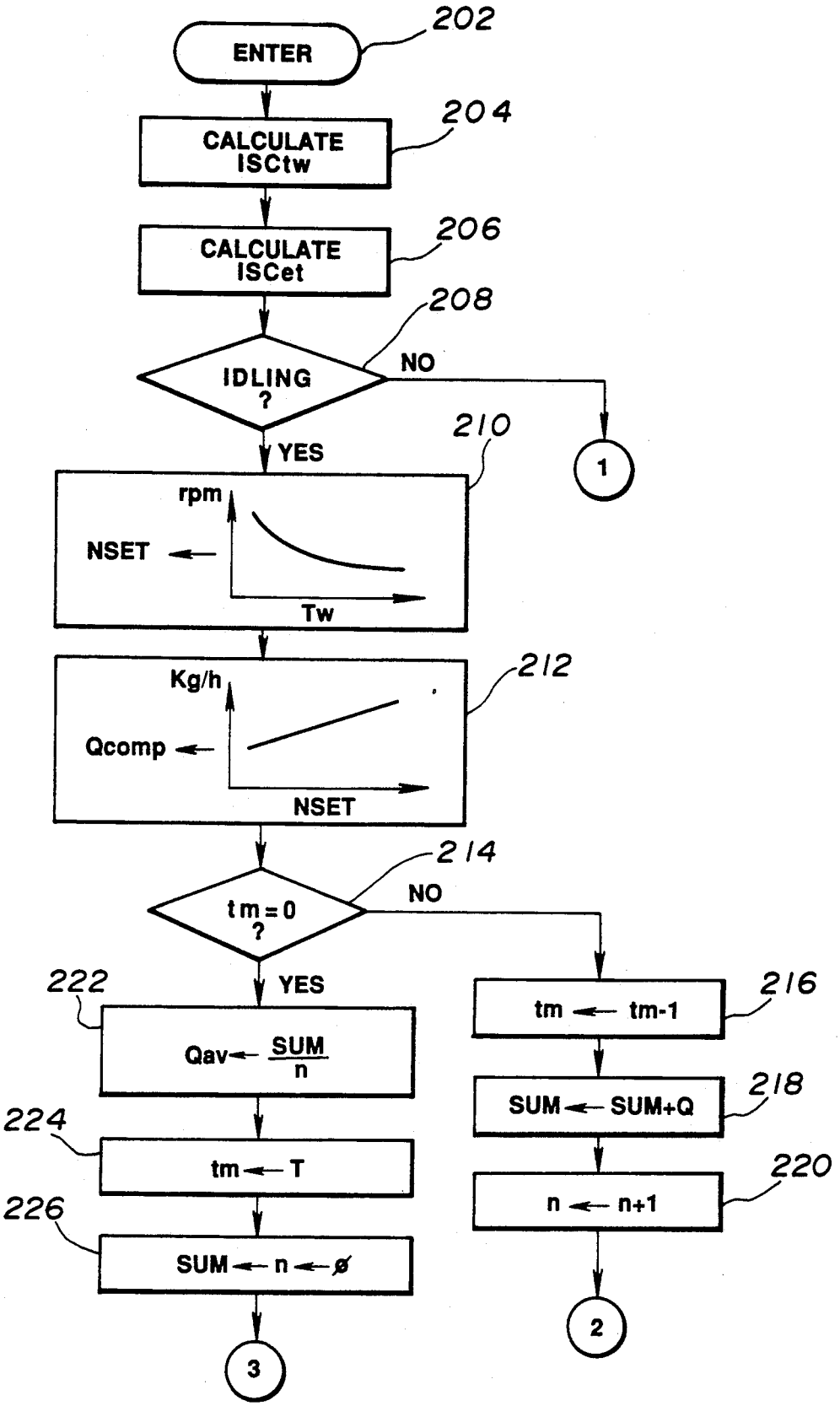
FIGS. 2 and 3 are flow diagrams showing the programming of the digital computer used in the engine idling speed control apparatus.
Figure 3:
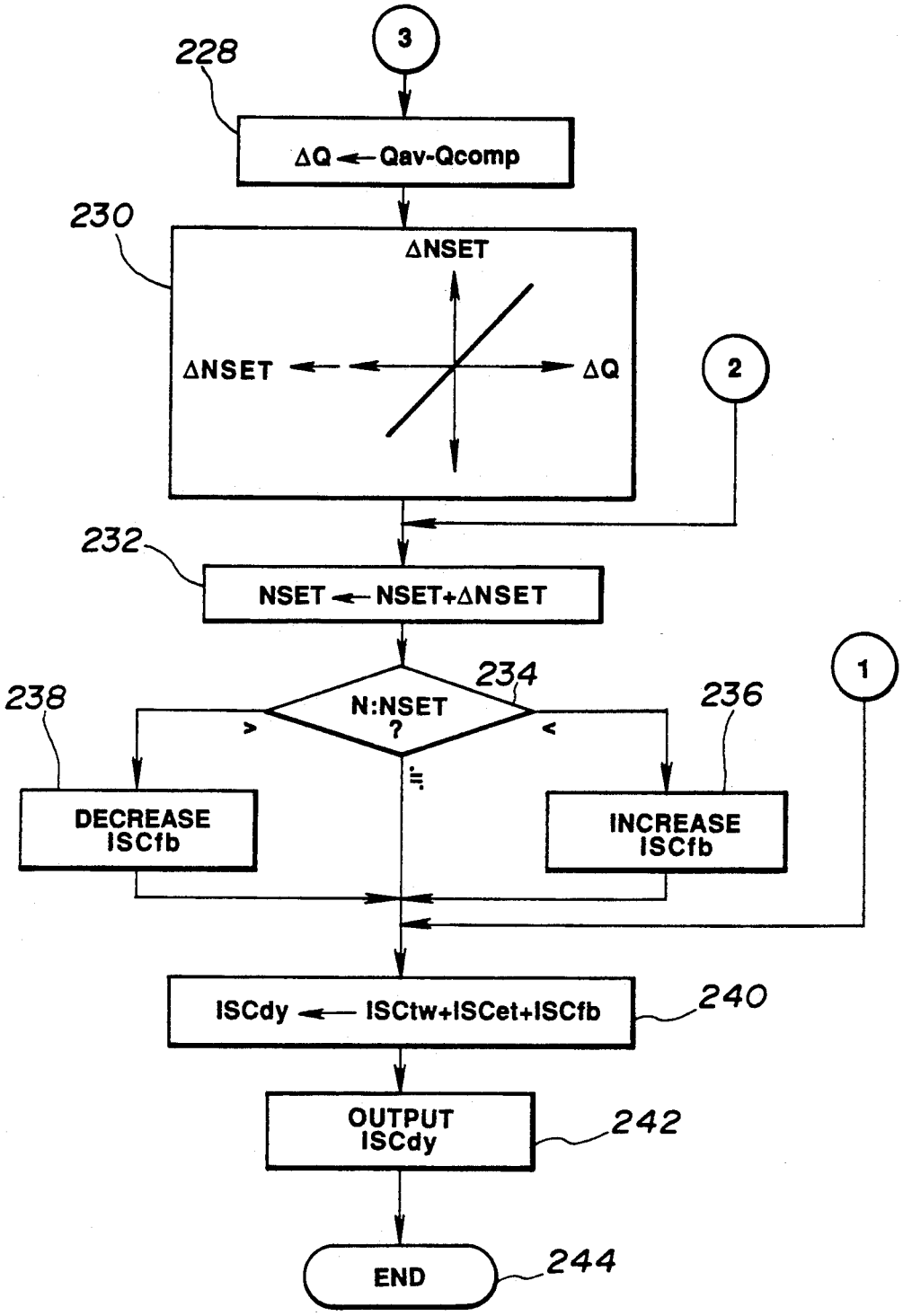

FIGS. 2 and 3 are flow diagrams illustrating the programming of the digital computer as it is used to control the auxiliary air control valve 20. The computer program is entered at the point 202 at uniform intervals of time, for example 10 ms. At the point 204 in the program, a basic value ISCtw for the duty factor of the electrical pulse signal applied to operate the auxiliary air control valve 20 based on the existing engine coolant temperature. For this purpose, the central processing unit looks at the basic value ISCtw in a look-up table which defines the basic value ISCtw as a function of engine coolant temperature Tw. At the point 206 in the program, the central processing unit calculates a first correction factor ISCet used to correct the basic value ISCtw in order to avoid sudden intake manifold vacuum changes during smooth acceleration or deceleration. At the point 208 in the program, a determination is made as to whether or not the engine is idling. The answer to this question is "yes" if the idle switch 33 is closed and if the neutral switch 34 is closed or the engine is operating at a speed less than a predetermined value, for example, 8 km/h. If the engine is idling, then it means that a feedback control is required to maintain a desired optimum engine idling speed and the program proceeds to the point 210. Otherwise, the program proceeds to the point 240 where the duty factor ISCdy of the electrical pulse signal applied to operate the auxiliary air control valve 20 is calculated with the second correction factor ISCfb being clamped.

At the point 210 in the program, the central processing unit looks at a target value NSET (rpm) for the engine idling speed in a look-up table which defines the target engine idling speed value NSET as a function of engine coolant temperature Tw, as shown in the block 210. At the point 212 in the program, the central processing unit looks at a reference value Qcomp (kg/h) in a look-up table. The reference value Qcomp corresponds to the amount of air required to enter the engine 10 so as to assure the target engine idling speed NSET at a predetermined external load condition. The external loads include the air conditioner compressor, the power steering oil pump, the alternator, and the other devices driven by the engine 10. This look-up table defines the reference value Qcomp as a function of the target engine idling speed value NSET calculated at the point 212, as shown in the block 212.

At the point 214 in the program, a determination is made as to whether or not the count tm of a timer is zero. If the answer to this question is "yes", then the program proceeds to the point 222. Otherwise, the program proceeds to the point 216 where the central processing unit produces a command causing the timer to count down by one step. At the pint 218 in the program, the central processing unit samples the existing intake air flow value Q and calculates a new integrated value SUM by adding the sampled intake air flow value Q to the old integrated value SUM. The new integrated value SUM is stored in the computer memory to update the old integrated value SUM. Thus, the intake air flow Q is sampled and integrated at uniform time intervals for a predetermined period of time during which the timer counts down to zero from a predetermined value T. At the point 220 in the program, the central processing unit produces a command causing a counter to count up by one step. This counter accumulates a count corresponding to the number of the intake air flow values which have been sampled and integrated. Following this, the program proceeds to the point 232 where the calculated target engine idling speed value NSET is corrected with the correction factor ΔNSET being not updated.

At the point 222 in the program, the central processing unit reads the integrated value SUM and calculates the average value Qav of the integrated value SUM as Qav=SUM/n. The average value Qav indicates the average value of the intake air flow Q for a predetermined period of time during which the timer counts down to zero from the predetermined value T. At the point 224 in the program, the timer is set at the predetermined value T. At the point 226 in the program, the central processing unit clears the integrated value SUM to zero and the count n to zero. Following this, the program proceeds to the point 228.

At the point 228 in the program, the central processing unit calculates a difference ΔQ by subtracting the calculated reference value Qcomp from the calculated average value Qav. The calculated reference value Qcomp is the amount of air required to enter the engine 10 in order to assure that the engine 10 can operate at the target engine idling speed NSET for a predetermined external load condition. Thus, it is required to move the idling speed control valve 20 in an opening direction when the external load increases. The calculated difference ΔQ is positive when the existing external load is greater than the predetermined external load for which the reference intake air flow value Qcomp is calculated, whereas the calculated difference ΔQ is negative when the existing external load is less than the predetermined external load for which the reference intake air flow value Qcomp is calculated. At the point 230 in the program, the central processing unit looks at a correction factor ΔNSET in a look-up table which defines the correction factor ΔNSET as a function of difference ΔQ, as shown in the block 230. The correction factor ΔNSET is positive when the calculated difference ΔQ is positive, whereas the correction factor ΔNSET is negative when the calculated difference ΔQ is negative.

At the point 232 in the program, the central processing unit corrects the calculated target engine idling speed value NSET by adding the correction factor ΔNSET to the calculated target engine idling speed value NSET. This correction is effective to increase the target engine idling speed value NSET so as to ensure stable engine idling operation when the external load increases and to decrease the target engine idling speed value NSET so as to provide fuel economy when the external load decreases. At the point 234 in the program, a determination is made as to whether or not the corrected target engine idling speed value NSET is equal to or greater than the existing engine speed N. If the corrected target engine idling speed value NSET is greater than the existing engine speed N, then the program proceeds to the point 236 where the central processing unit increases a second correction factor ISCfb by a predetermined value and then to the point 240. If the corrected target engine idling speed value NSET is less than the existing engine speed N, then the program proceeds to the point 238 where the central processing unit decreases the second correction factor ISCfb by the predetermined value and then to the point 240. If the corrected target engine idling speed value NSET is substantially equal to the existing engine speed N, for example, (NSET−25) rpm≧N≧(NSET+25) rpm, then the program proceeds directly to the point 240. The second correction factor is used to provide an engine idling speed feedback control.

At the point 240 in the program, the duty factor ISCdy of the electrical pulse signal applied to operate the auxiliary air control valve 20 is calculated, as ISCdy=ISCtw+ISCet+ISCfb, by adding the first and second correction factors ISCet and ISCfb to the basic value ISCtw. At the point 242 in the program, the calculated duty factor value ISCdy is transferred by the central processing unit to the input/output control circuit which thereby produces an electrical pulse signal to operate the auxiliary air control valve 20 with a duty factor corresponding to the value ISCdy calculated by the computer. Following this, the program proceeds to the end point 244.

According to the invention, a difference ΔQ of a reference value Qcomp from the actual intake air flow Qav is calculated to provide an inference of the change in the external load exerted on the engine 10. Thus, the invention can eliminate the need for the use of various switches which have been required to indicate the conditions of the respective external loads. This results in an inexpensive idling speed control apparatus. The invention can also provide an good correspondence of the target engine idling speed value NSET to the actual external load change even though the external loads include a variable capacity type compressor used in the air conditioner or the like changing in a plurality of stages or not changing in an on/off fashion. It is, therefore, possible to maintain the lowest possible engine idling speed without sacrificing stable engine idling operation. This is effective to provide improved fuel economy.

While the invention has been described to provide an influence of the change in the external load exerted on the engine by a change in the intake air flow Q, it is to be understood that the external load change may be inferred by the sensed change of the value Q/N where Q is the air flow rate and N is the engine speed, or by the sensed change of the basic fuel-injection pulse-width Tp=K×Q/N where K is a constant), or by the sensed change of the intake manifold vacuum.

While the invention has been described in conjunction with specific embodiments thereof, it is evident that many alternatives, modifications and variations will be apparent to those skilled in the art. Accordingly, it is intended to embrace all alternatives, modifications and variations that fall within the scope of the appended claims.

What is claimed is:

1. An apparatus for controlling the idling speed of an internal combustion engine, comprising:

sensor means sensitive to engine operating conditions for producing electrical signals indicative of sensed engine operating conditions including a sensed amount of air permitted to enter the engine; and a control unit coupled to the sensor means for providing a feedback control to correct the amount of air permitted to enter the engine so as to maintain the engine idling speed at a target value when the engine is idling, the control unit including means for calculating a difference of the sensed air amount from a reference value, and means for correcting the target engine speed based upon the calculated difference.

2. The engine control apparatus as claimed in claim 1, wherein the control unit includes means for calculating the target engine idling speed value based upon the sensed engine operating conditions, and means for calculating the reference value based upon the calculated target engine idling speed value.

3. The engine control apparatus as claimed in claim 1, wherein the sensor means includes means responsive to an engine coolant temperature for producing an electrical signal indicative of a sensed engine coolant temperature, and wherein the control unit includes means for calculating the target engine idling speed value as a function of the sensed engine coolant temperature, and means for calculating the reference value as a function of the calculated target engine idling speed value.

* * * * *